United States Patent [19]

Bigelow, Jr.

[11] 4,007,833

[45] Feb. 15, 1977

[54] BUILDING SYSTEM

[76] Inventor: Floyd E. Bigelow, Jr., P.O. Box 7064, Houston, Tex. 77008

[22] Filed: July 10, 1975

[21] Appl. No.: 594,764

[52] U.S. Cl. ..... 206/321; 52/143; 206/600

[51] Int. Cl.[2] ..... B65D 85/46; B65D 19/00; E04B 1/34; E04H 1/12

[58] Field of Search ..... 206/386, 321, 322–325; 52/143

[56] References Cited

UNITED STATES PATENTS

| | | | |
|---|---|---|---|
| 3,410,041 | 11/1968 | Bolt et al. | 52/143 |
| 3,680,273 | 8/1972 | Bigelow, Jr. | 206/321 |
| R25,827 | 8/1965 | Bigelow, Jr. | 206/386 |

*Primary Examiner*—William Price
*Assistant Examiner*—Douglas B. Farrow
*Attorney, Agent, or Firm*—Vinson, Elkins, Searls, Connally & Smith

[57] ABSTRACT

A knock-down building shipping package in which modules of a building are packed on skids and the skids stacked one upon the other with the weight of an upper module being transferred directly from its skid to a lower module skid.

4 Claims, 5 Drawing Figures

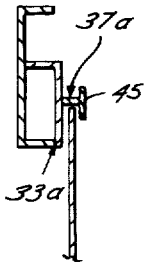
Fig. 5
Fig. 3
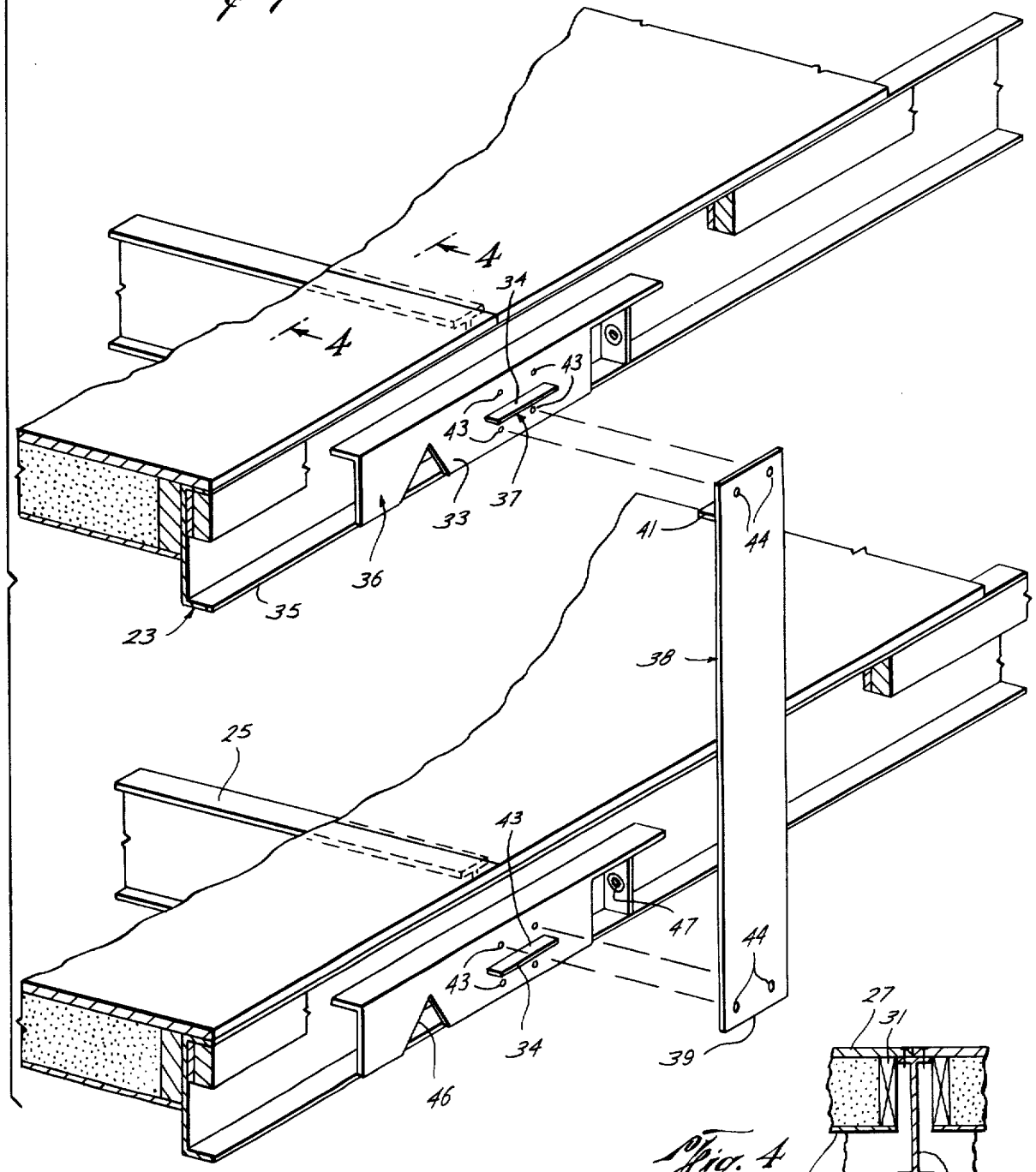
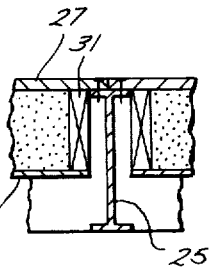
Fig. 4

BUILDING SYSTEM

This invention relates to a knock-down building shipping package and more particularly to a system of stacking building modules.

In the past knock-down buildings have been stacked one upon the other for shipping. One system for shipping stacked knock-down buildings is shown in Bigelow U.S. Pat. No. 25,827. While the system shown in the Bigelow patent is highly satisfactory for camp-type buildings, it is not suitable for modules of a building which are to be assembled together to closely resemble a built-in-place home. The extension of the skids beyond the building in the Bigelow patent to permit the use of stacking racks is objectionable when it is desired to provide a building which resembles a conventional built-in-place home.

It is an object of this invention to provide a system of stacking knock-down modules of a building in which the modules when assembled may closely resemble a built-in-place home.

Another object is to provide a system of stacking knock-down modules of a building in which the weight of an upper module is transferred directly from its skid to a lower module skid and in which it is not required that the skid project beyond the floor of the module.

Other objects features and advantages of this invention will be apparent from the specification, the drawings, and the claims.

In the drawings wherein an illustrative embodiment of this invention is shown and wherein like numerals indicate like parts, FIG. 1 illustrates three modules in stacked condition ready for shipment;

FIG. 3 is a fragmentary exploded view of the peripheral runners of skids and floor assembled therewith illustrating the details of construction of the preferred form of stacking rack;

FIG. 4 is a view along the lines 4—4 of FIG. 3; and

FIG. 5 is a fragmentary view showing a modified form of this invention.

Figure 1:
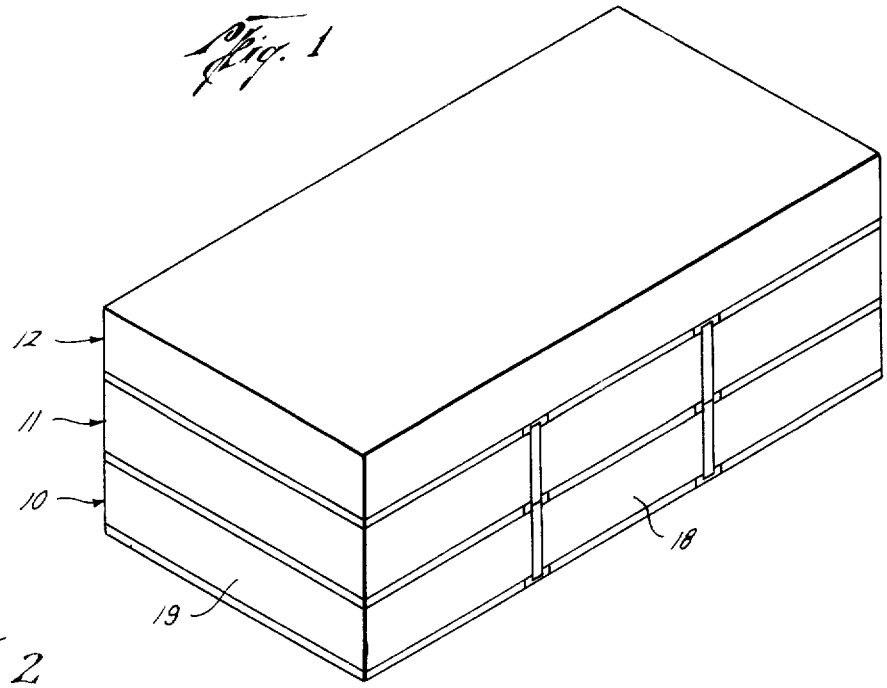

The knock-down building shipping package of FIG. 1 includes modules indicated generally at 10, 11, and 12.

Figure 2:
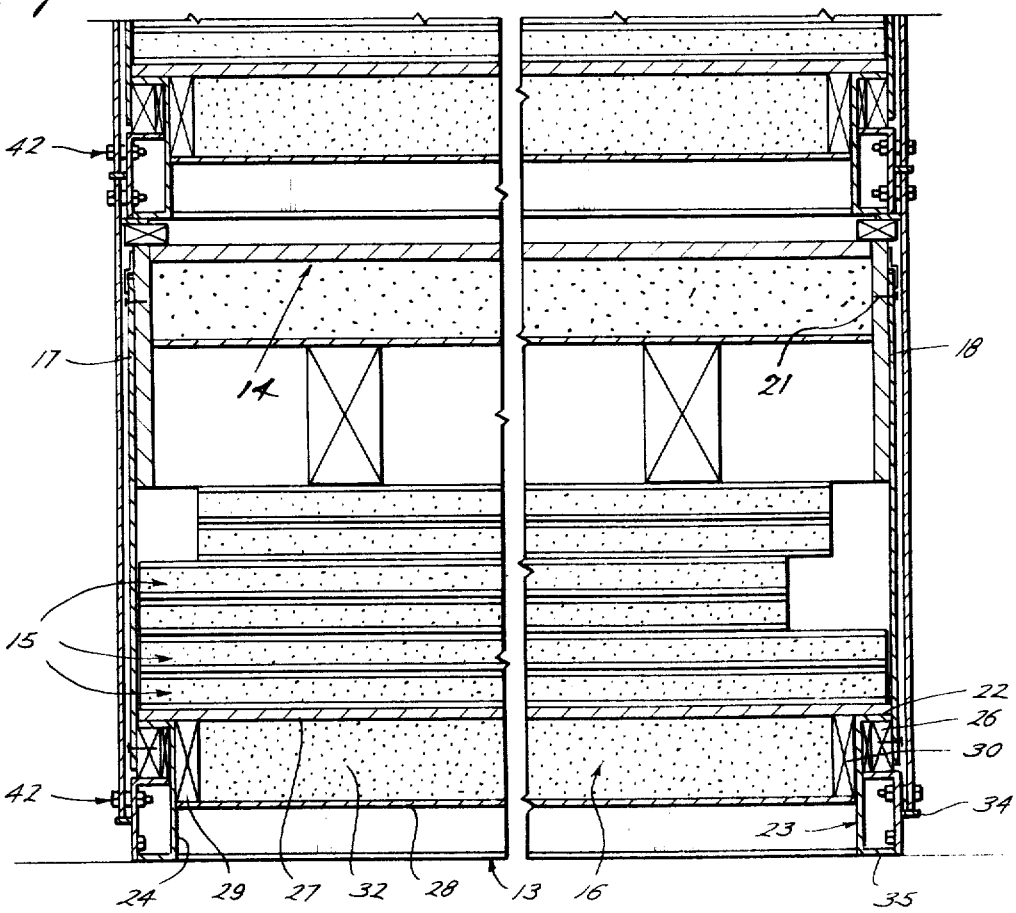
FIG. 2 is a sectional view through a lower module and a portion of an upper module illustrating this invention.

As best seen in FIG. 2, each module includes a skid indicated generally at 13, a roof section indicated generally at 14, and a plurality of other building sections such as walls stacked between the skid and roof. Preferably, the floor, indicated generally at 16 of each module, is secured to the skid at the factory and underlies the building components 15 as illustrated. The floor extends to and overlies the skid runner 23 on opposite sides of the module.

A protective member extends between the skid and roof and surrounds the building parts. This member may be provided by sheets of plywood 17, 18, and 19 which are secured to the roof by nails 21 and extend down to a point below upper flange 22 of peripheral skid channel 23. The roof 14 is provided with a weather-proofing material over its upper surface and a Z-shaped member 24*a* provides a weather-tight joint between the roofing material and the upper end of the plywood protecting member 18. This assembly gives a substantially water-tight package for shipping.

The skid is provided by peripheral channels 23 and 24 which are interconnected at points spaced therealong by I-beams 25. Each I-beam has secured thereto at points spaced therealong nailing block 26 to which the protective member 18 may be secured as illustrated. These blocks also provide an attachment point when the walls are attached to the skid.

As shown, each floor 16 is made up of modular sections of upper and lower facing material 27 and 28 spaced apart by peripheral wooden spacers 29, 30 and 31 (FIG. 4). The cavity in between these members is filled with insulating material 32 as shown.

To provide for securing stacking racks to the skids, the channel runners 23 and 24 which extend along the periphery of opposite sides of the modules include at points spaced therealong a vertically extending section and horizontally extending upwardly and downwardly facing surfaces projecting from said section. In the preferred form illustrated, an angle iron member indicated generally at 36 is secured to a channel runner 25 as by welding and the vertically extending section 33 of the angle iron provides the vertically extending section. An outwardly extending flange indicated generally at 37 is secured to the vertically extending section 33 of the angle iron and its upper surface 34 provides the upwardly facing surface. The lower surface of lower flange 35 of the channel member 23 provides the downwardly facing surface.

A plurality of stacking racks indicated generally at 38 extends between adjacent skids. Each stacking rack has a downwardly facing surface provided by the lower end of 39 of the stacking rack 38 which engages the upwardly facing surface 34 to support the stacking rack on a lower skid. Each stacking rack also has an upwardly facing surface provided by flange 41 secured to the upper end of each stacking rack. This upwardly facing surface engages the downwardly facing surface 35 of an upper skid runner to support the upper module upon the lower module.

Means are provided for removably securing the stacking racks to the skid and in the illustrated form is provided by the bolt and nut assemblies 42 extending through the several holes 43 in the vertically extending section and holes 44 in the opposite ends of the stacking racks.

In assembling the stacking racks it is customary to secure the stacking rack to a lower skid and to then rest an upper module on the upwardly facing surfaces 41 of the stacking racks. There is a tendency for the stacking racks to bow outwardly during this operation and the flange 41 is therefore designed to project a sufficient distance under the surface of the downwardly facing surface 35 to support an upper module even though the stacking rack may tend to bow outwardly.

In the alternative form as shown in FIG. 5, the flange 37*a* is carried on the vertically extending section 33*a* and has at its free end a short vertically extending flange 45 which extends above and below the flange 37*a*. This provides a H-shaped configuration in cross-section which receives the upper and lower ends of the stacking racks 38 to limit their movement in an outer direction.

The downwardly facing V groove 46 in angle member 36 and hole 47 in a flange between the angle member and channel flange 35 provide for the attachment of gear to lift or move the module.

The foregoing disclosure and description of the invention are illustrative and explanatory thereof and various changes in size, shape, and materials, as well as in the detail of the illustrated construction, may be made within the scope of the appended claims without departing from the spirit of the invention.

What is claimed is:

1. A knock-down building shipping package comprising, a plurality of stacked building modules, each including a spaced apart roof and skid with building parts sandwiched between the skid and roof;

a protective member extending between the skid and roof, and surrounding said building parts, each skid including runners extending along the periphery of opposite sides of the modules and not extending beyond the ends thereof and including at points spaced therealong a vertically extending section and horizontally extending upwardly and downwardly facing surfaces projecting from said section, a plurality of stacking racks between each pair of skids each having a downwardly facing surface engaging said upwardly facing surface and an upwardly facing surface engaging said downwardly facing surface to support an upper module upon a lower module, and means removable securing the stacking racks to the skids.

2. The package of claim 1 wherein means are provided in association with said first mentioned downwardly facing surfaces for limiting outward movement of said stacking racks after they have been secured to a first module and while they are supporting an upper module and before the racks have been secured to the second module.

3. The package of claim 1 wherein one of said building parts provides a floor having an upper layer extending to and overlying said runners on opposite sides of the module, and the securing means fastens the stacking racks to said vertically extending sections.

4. A knock-down building shipping package comprising, a plurality of stacked building modules, each including a spaced apart roof and skid with the building parts sandwiched between the skid and roof, a protective member extending between the skid and the roof and surrounding said building parts, each skid including outwardly facing channel runners extending along the periphery of opposite sides of the modules, one of said building parts providing a floor having an upper layer extending to and overlying said channel runners, stacking plates secured to said runners, each plate having a vertical surface approximately flush with the free end of the channel runner flanges, a support flange extending outwardly from each stacking plate, a stacking rack supported on the upper surface of each support flange, each stacking rack including a flange extending inwardly and engaging the lower flange of a channel runner on an upper module, and means for removably securing the stacking racks to said stacking plates.

* * * * *